United States Patent [19]

Louw

[11] Patent Number: 4,851,600

[45] Date of Patent: Jul. 25, 1989

[54] PROCESS FOR THE DESTRUCTION OF WASTE BY THERMAL PROCESSING

[75] Inventor: Robert Louw, Koudekerk A/D Rijn, Netherlands

[73] Assignee: Rijksuniversiteit Leiden, Leiden, Netherlands

[21] Appl. No.: 770,392

[22] Filed: Aug. 28, 1985

[30] Foreign Application Priority Data

Aug. 30, 1984 [NL] Netherlands ..... 8402641

[51] Int. Cl.[4] ..... C10G 67/06

[52] U.S. Cl. ..... 585/240; 208/13; 208/262.1; 208/263; 208/209; 208/254 H; 208/262.5; 48/197 A; 201/25

[58] Field of Search ..... 585/240; 208/13, 262, 208/263, 209, 254 H; 48/197 A; 201/25

[56] References Cited

U.S. PATENT DOCUMENTS

| | | | |
|---|---|---|---|
| 470,911 | 3/1892 | Dubbs | 208/209 |
| 2,774,800 | 12/1956 | Shmidl et al. | 585/240 |
| 2,929,682 | 3/1960 | Clark | 585/240 |
| 3,595,931 | 7/1971 | Hay et al. | 260/668 |
| 3,855,347 | 12/1974 | Oricchio | 585/240 |
| 3,969,427 | 7/1976 | Bell et al. | 585/240 |
| 4,293,404 | 10/1981 | Farcasiu et al. | 208/263 |
| 4,301,137 | 11/1981 | Williams et al. | 585/240 |
| 4,308,411 | 12/1981 | Frankiewicz | 585/240 |
| 4,338,186 | 7/1982 | Reif et al. | 208/254 H |
| 4,351,978 | 9/1982 | Hatano et al. | 210/909 |
| 4,364,745 | 12/1982 | Weil | 201/25 |
| 4,396,786 | 8/1983 | Bond et al. | 585/240 |
| 4,493,761 | 1/1985 | Hensley, Jr. et al. | 585/240 |
| 4,526,675 | 7/1985 | Mahoney et al. | 585/240 |
| 4,587,007 | 5/1986 | Rudnick | 208/107 |
| 4,618,736 | 10/1986 | Benn et al. | 585/240 |
| 4,623,448 | 11/1986 | O'Connell et al. | 208/179 |
| 4,652,686 | 3/1987 | Coenan et al. | 201/25 |

FOREIGN PATENT DOCUMENTS

| | | | |
|---|---|---|---|
| 2721290 | 11/1978 | Fed. Rep. of Germany | 585/240 |
| 2930032 | 1/1981 | Fed. Rep. of Germany | 585/240 |
| 2089831 | 6/1982 | United Kingdom | 585/240 |

*Primary Examiner*—H. M. S. Sneed
*Assistant Examiner*—Helane Myers
*Attorney, Agent, or Firm*—Ladas & Parry

[57] ABSTRACT

The invention relates to a process for the destruction of waste, like biologically difficult to degrade halogen-, nitrogen-, sulphur-, and/or oxygen containing compounds by thermal hydrogenolysis. The waste materials are heated together with an excess hydrogen and/or hydrogen donor during 1 to 10 sec. to a temperature between 700°-1220° C., followed by quenching the gaseous effluent of the reaction and separating it in a hydrocarbon and hydrogen containing phase and a hydrogen halogenide(s) nitrogen-, sulphur-, and/or oxygen containing compounds containing phase.

Preferably the hydrogenolysis is performed in two steps, first during 1-10 sec. at 700°-900° C. and second during 1-10 sec. at 850°-1200° C.

27 Claims, 3 Drawing Sheets

PROCESS FOR THE DESTRUCTION OF WASTE BY THERMAL PROCESSING

Figure 1:
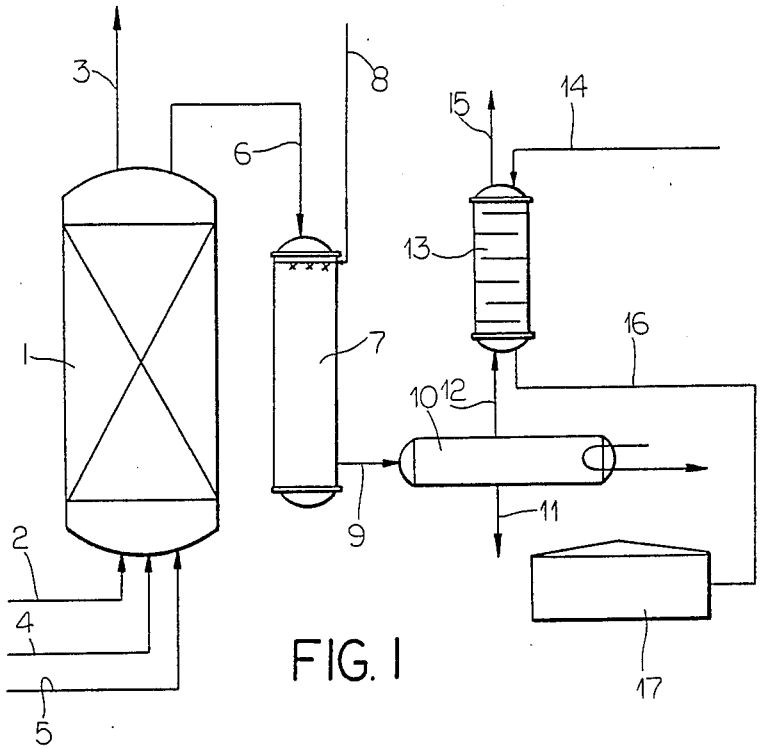

The invention concerns a process for the destruction of waste, like halogen-, nitrogen-, sulphur-, and/or oxygen containing organic compounds which hardly degrade biologically, by thermal processing.

One of the great problems modern communities are envisaging, is the burdening of the environment with all kinds of waste. Deposit of such waste on selected belts is only possible on a limited scale partly by the lack of space and on the other side since only those kinds of wastes are allowed which impose no health risk or if it is degraded biologically gives harmless products.

Many waste materials cannot be deposited in this way because they are poisonous, and impose health risk, or because they are offered in too large quantities and are difficult biologically degradable. Examples of this kind of waste are: pesticides, like aldrin, dieldrin, chlordane, hexachlorcyclohexane and transformable oils polychlorinated biphenyls which are toxic; residues of the preparation of pesticides and polychlorinated biphenyls, which contain besides traces of pesticides and of polychlorinated biphenyls also toxic oxygen containing compounds (dioxine); polyvinylchloride waste which is offered in large quantities and since it is not biologically degradable forms a big problem.

Until now this kind of waste is destructed by combustion imposing very stringent demands on the combustion conditions since incomplete combustion often results in the very remaining of the most toxic components of the waste which are the most stable, or generation of toxic compounds like dioxines and (chlorinated) dibenzofuranes.

The temperatures that are applied for the combustion of this kind of waste are in the order of 1400°-1500° C. (see "Ocean Combustion Service Brochure" and "Recycling International", Berlin 1982, p. 723-729), which imposes high requirements on the choice of material for the combustion installation and the regulation of the combustion.

In the present invention it was found, that waste materials like biologically difficult to degrade halogen, nitrogen, sulphur and/or oxygen containing compounds can be destructed under less rigorous conditions by thermal hydrogenolysis. The waste materials, together with an excess hydrogen or a hydrogen donor e.g. methanol are heated during 1-10 seconds to a temperature between 700° and 1200° C. under which conditions functional groups in the waste material (halogen atoms, hydroxyl groups, alkoxy groups, aryloxy groups, sulphur containing groups, nitrogen containing groups, etc.) are splitted off and the organic structures and the hydrocarbons formed are partly converted to smaller hydrocarbons and eventually carbon.

Whereas, in the case of combustion there is always a chance that extremely toxic compounds like (chlorinated) dibenzo furanes and dioxines are formed, the formation of this kind of compounds is actually prevented in the case of thermal hydrogenolysis. If this kind of compounds are present in the waste processed, they will be broken down to in essence benzene, hydrogen chloride and water. Also condensation reactions, e.g. occuring in pyrolysis (heating in an inert atmosphere) and leading to the formation of considerable amounts of tar and carboneous materials, are prevented in the case of thermal hydrogenolysis.

The hydrogenolysis is not influenced by the presence of metals or metal salts (no inhibition) and so is universally applicable. Together with hydrogen(donor) an inert gas (nitrogen, oxygen free or oxygen poor combustion gases etc.) may be applied.

By quenching the gaseous and vaporous effluent of the hydrogenolysis reaction and by separating the hydrogen-halogenide, nitrogen-, sulphur-, and possibly oxygen-containing compounds HCl, $NH_3$, HCN and $H_2S$, the hydrocarbons and hydrogen-containing phase remains, which can be used or flared without problems.

The invention concerns generally to a process for the destruction of waste, wherein the waste materials are subjected to hydrogenolysis. In particular the invention concerns a process comprising heating of the waste materials together with an excess of hydrogen or a hydrogen donor during 1-10 seconds at a temperature between 700°-1200° C., quenching the gaseous effluent of the reaction and separation of the effluent in a hydrocarbon and hydrogen containing phase and a hydrogen halogenide-, nitrogen-, sulphur-, and/or oxygen-compounds containing phase.

The hydrogenolysis temperature has to be at least 700° C. since otherwise the decomposition reaction of some types of organic compounds is too slow and incomplete. At temperatures above 1200° C. cracking reactions are dominating and carbon formation can present problems.

More particularly it is favourable to work with 2 reactors in series, for which in the first reactor at temperatures between 700-900C. a large part of the hetero atoms containing compounds decompose and in the second reactor at higher temperatures further decomposition occurs. In this manner a higher desired decomposition grade is reached.

An optimal result is obtained in the second reactor at temperatures between 950°-1050° C.; the decomposition of the waste materials is then over 99.99% at contact times between 1-10 secs., with minor soot formation.

It is of utmost importance for the hydrogenolysis, that the waste materials are heated to the aimed temperature in a fast and uniform way. This is reached efficiently by contacting the waste materials and hydrogen or a hydrogen donor with a preheated mass of contact bodies, or by spraying the waste materials by means of a hot neutral or reducing gas.

Using contact bodies these can suitably form "packed column", which in particular for application on a small scale is an excellent possibility. For working on a larger scale a fluidized bed is a good alternative.

The contact bodies used in a packed column can be e.g. raschig rings, berl saddles, lessing rings, pall rings from fireproof material e.g. silicium dioxide, aluminium oxide or silicium carbide, or from resistant metal like stainless steel.

The contact bodies applied in a fluidised bed are more particularly from an inert granular material, compatible with the reaction temperature. Sand forms a cheap material very suitable for this purpose, but also aluminium oxide (korund) and similar hard granular materials that are compatible with high temperatures are useful.

The particle size of the sand or any other granular material applied in the fluidised bed is within the normal range from 50 μm till 1 mm, more in particular between 50 and 300 μm since in this range the reaction works most favourable.

The hydrogen or hydrogen donor applied in this procedure according to the invention has to be in excess with respect to the organic waste materials that are hydrogenolised. This means that more than 1 mol equivalent hydrogen per mol equivalent bonds to be broken has to be applied.

For a compound like dichlorobenzonitril with three bonds to be broken, for which the hydrogenolysis reaction can be represented as follows:

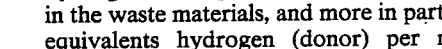

$$Cl_2C_6H_3CN+3H_2 \rightarrow C_6H_6+2HCl+HCN$$

This implies e.g. more than 3 mol hydrogen per mol feed waste material.

Preferentially 1.5 to 7 mol equivalents hydrogen or hydrogen donor per mol equivalent bonds to be broken in the waste materials, and more in particular 2 to 4 mol equivalents hydrogen (donor) per mole equivalent bonds to be broken, is used. Within the last mentioned range an excellent hydrogenolysis with minimal soot formation is obtained.

To obtain a heating efficiency as favourable as possible and a smooth hydrogenolysis reaction, the waste material and/or the hydrogen(donor) is preferentially preheated before being fed in the reactor. The preheating temperature is at least 200° C. and preferentially between 350°-500° C.

The preheating of the waste materials and/or the hydrogen (donor) can be performed in the usual way e.g. by leading the liquid or gaseous waste material through a heat exchanger and in the case of solid waste materials, e.g. polymers like polyvinylchloride, by powdering and dispersion the powder in a suitable solvent and leading this dispersion through a heat exchanger.

The liquid waste materials are vapourized during preheating, which facilitates the feeding into the hydrogenolysis reactor, waste materials giving rise to coke formation in the case of preheating may be atomised with the hydrogen(donor) and enter the hydrogenolysis reaction in this form without problems.

The procedure according to the invention gives good results when hydrogen is used for the hydrogenolysis reaction. Since, however, hydrogen is expensive a hydrogendonor is preferred, which means a compound that splits off hydrogen under reaction conditions and has no or hardly any disadvantageous influence on the course of the reaction. A suitable hydrogen donor is e.g. methanol.

The effluent of the hydrogenolysis reaction is quenched, inter alia to prevent cracking reactions, giving soot formation and excessive fouling of the reactor.

In principle every cold liquid with a suitable heat coefficient can be applied.

Water meets this requirement in every respect and can be perfectly used; the use of water as quenching medium implies, however, special precautions, since water is also a solvent for the reaction byproducts like HCl, $H_2S$, $NH_3$, HCN, etc. and the water vapour formed may given corrosion problems.

For this reason preferably a cold hydrocarbon with a boiling point between 60° and 100° C. is used as quenching medium. HCl etc. is hardly soluble in such hydrocarbons and HCl etc. is hardly corrosive in a hydrocarbon vapour environment.

More particularly benzene is a very suitable quenching agent, with favourable physical properties for this purpose.

Another suitable quenching medium is heptane which also has favourable physical properties and with respect to benzene has the advantage that it is not toxic. The gaseous effluent of the hydrogenolysis reaction after quenching is separated in a liquid hydrocarbon containing phase and a gaseous phase containing hydrogen, light hydrocarbons, hydrogen halogenides, $H_2S$, $NH_3$, HCN containing compounds and similar compounds.

The gaseous effluent is subsequently separated in a hydrogen and light hydrocarbons containing phase and a hydrogen halogenides nitrogen-, and sulphur-compounds containing phase.

The gaseous effluent is contacted preferably with an absorbent for the last mentioned compounds to effect this separation.

Water is preferably used as an absorbent since it is cheap and easily available and it is a suitable solvent for the aimed compounds.

The hydrogen and light hydrocarbons containing phase can be recycled to the reactor or, if two reactors in series are used, this stream together with the liquid hydrocarbons containing stream can be fed to the second reactor.

As mentioned before a small degree of soot formation also occurs during hydrogenolysis. This soot is deposited on the contacting bodies in the reactor. To prevent disturbance of the process by soot formation the soot content has to be controlled.

In a reactor with a packed column this is obtained by interrupting the hydrogenolysis reaction at regular intervals, replacing the waste material and hydrogen (donor) with an inert gas e.g. nitrogen, and burning the soot which is deposited on the packing with air, oxygen or oxygen enriched air. Not only soot is removed in this way, but also the packing is heated by the heat of combustion, in which way the next hydrogenolysis step can start without problems at the right temperature. After burning off the soot the packed column is flushed with hot inert gas (e.g. nitrogen, to remove the oxygen, and subsequently the waste material and hydrogen(donor) are fed to the column and the hydrogenolysis reaction starts again.

In a fluidised bed reactor the soot deposition on the granular contact bodies can be kept within an acceptable range, by diminishing or interrupting the waste feed in such a way that the soot can react with hydrogen.

Embodiments of the present invention may be found in the following examples. These embodiments and examples are presented for purposes of illustration only and are not intended to limit the scope of the invention.

FIG. 1 gives a schematic diagram of the installation for performing the procedure according to the invention in which a packed column is used.

Figure 2:
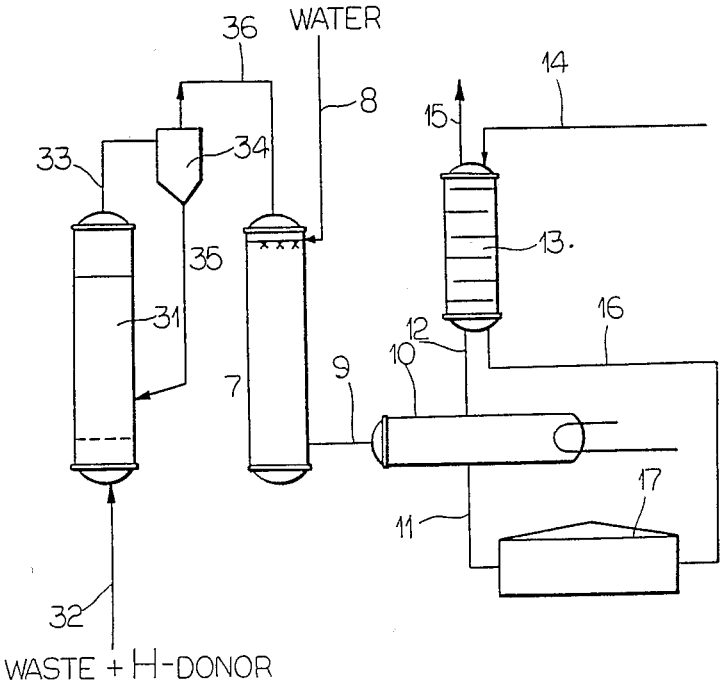

FIG. 2 is a schematic drawing of the installation performing once again the procedure according to the invention using a fluidized bed reactor.

Figure 3:
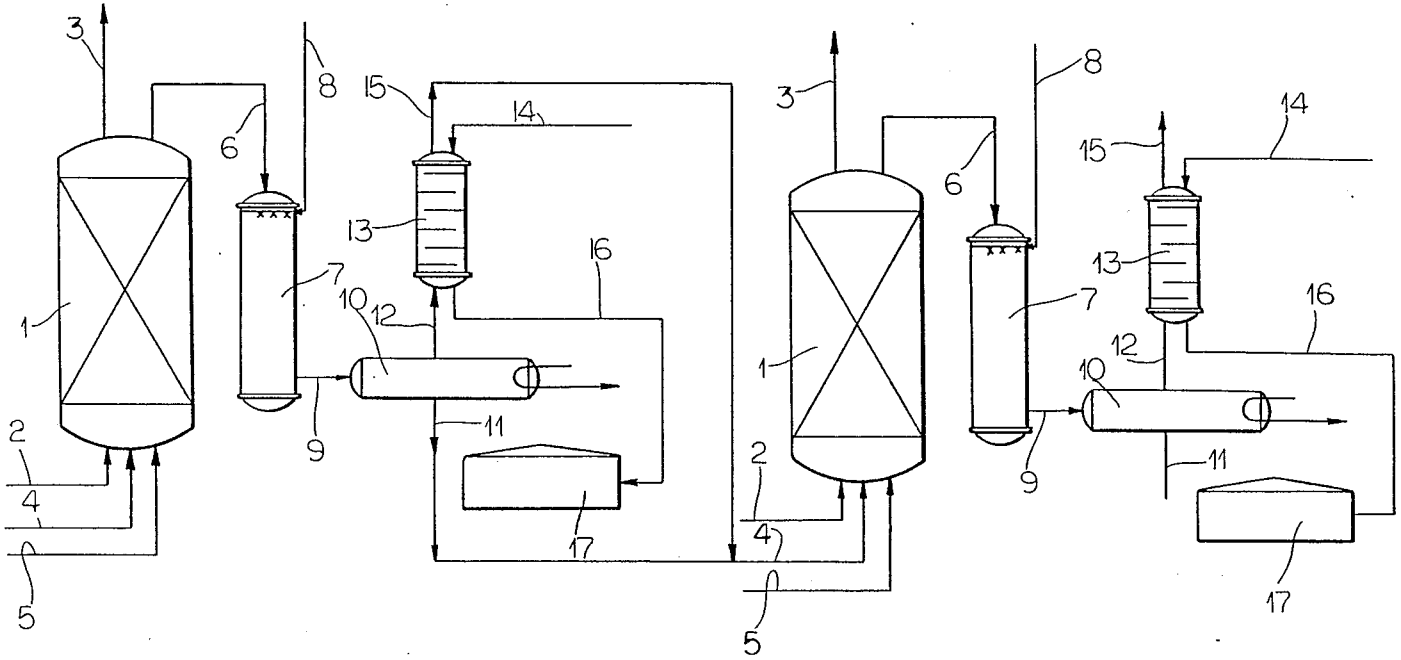

FIG. 3 give a schematic diagram of the installation for performing the procedure according to the invention using two reactors in series with intermediate removal of by-products.

Figure 4:
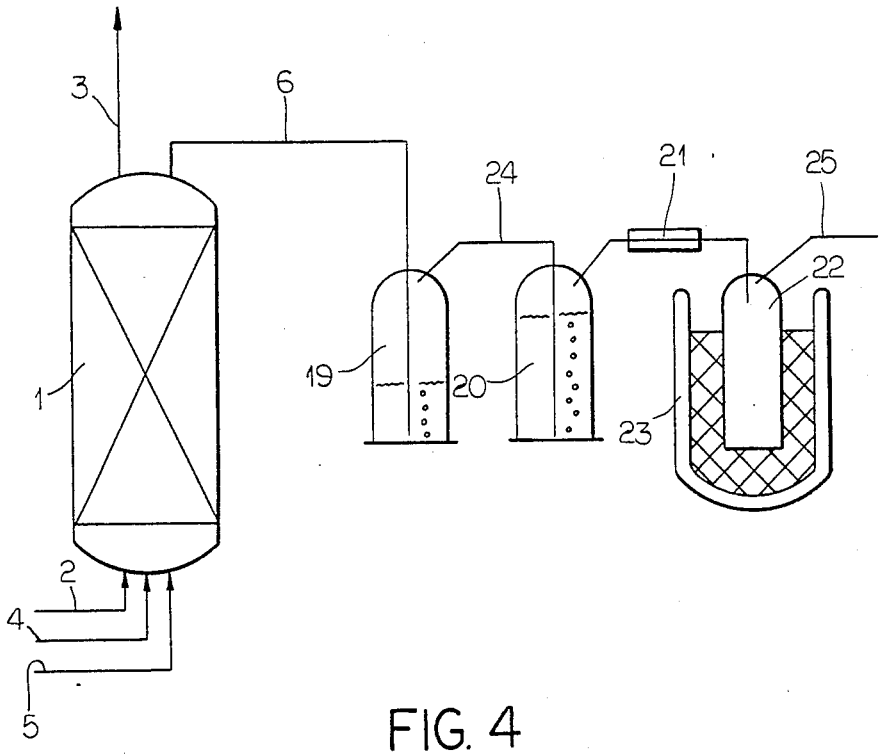

FIG. 4 gives a schematic diagram of a modified form of the installation according to FIG. 1 designed for performing the procedure according to the invention at a laboratory scale.

In the figures corresponding parts have been assigned the same reference numbers.

The installation of FIG. 1 comprises : a vertical reactor vessel filled with, e.g. raschig-rings, acting as packed column 1. A pipeline 2 for feeding hot combustion gases generated in the usual way (not depicted) by burning hydrocarbon fuel (varying from propane to naphtha with air or oxygen enriched air, or used for feeding gas for burning off soot, and a discharge line for used combustion gases, 1. A pipeline 4 for feeding waste material to be hydrogenolysed and a pipeline 5, for hydrogen gas (if necessary mixed with inert gas like e.g. nitrogen), or for hydrogen donor gas or vapour, e.g. methanol. The discharge line, 6, for the gaseous effluent of the packed column 1, ending in a quench cooler 7 (heat exchanger in which the hot effluent is contacted with cold cooling liquid) to which a cooling liquid (e.g. water, benzene or heptane) is feeded by line 8.

A discharge line 9 for transport of the vapour mixture of effluent and cooling liquid to condensor 10, where the temperature is lowered further. Condensor 10 has a discharge line 11 for the liquid phase and a discharge line 12 for the gaseous components. The gaseous components enter the absorption column 13 by this line 12 where the gaseous components are contacted with an absorbent, e.g. water to remove the hydrogen halogenides, nitrogen- and/or sulphur components formed during the hydrogenolysis reaction, the absorbent is added via line 14. The remaining gaseous components (mainly hydrogen, light hydrocarbons and co) are discharged by line 15 at the top of the absorption column. The absorbent with absorbed hydrogen halogenides, nitrogen- and/or sulphur compounds, is discharged by line 16 to vessel 17 (e.g. hydrochloric acid, ammonia etc.).

Starting the process, hot combustion gases are fed to the column by line 2 to heat the packing. The gas is discharged by line 3. As soon as the temperature of the packing has reached a temperature of 1050°-1300° C., line 2 and 3 are closed and during a shortwhile the column is flushed with hot inert gas. Subsequently the waste material that has to be hydrogenolised is added in the vapour state (temperature abt. 400C.) by line 4 to column 1 and preheated hydrogen (or hydrogendonot) in the vapour state temperature between 200°-400° C.) is added by line 5 to column 1. If desirable the waste material and hydrogen(donor) may also be mixed before entering the packed column.

The hydrogen (donor) can also be used to spray the liquid waste material into the reactor.

If waste material in the solid state has to be processed, e.g. polyvinylchloride waste, it is first milled and then suspended in the hydrogendonor stream and fed to the column. In the column the waste material and the hydrogen (donor) is heated quickly to about 1000°-1200° C., which temperature decreases slowly as the column is used longer. Feeding the waste material and the hydrogen (donor) is interrupted as soon as the temperature at the top of the rector falls below 950°-1100° C. Subsequently hot combustion gases are fed again to column 1 to increase the temperature, in which case also carbon containing material deposited on the packing (soot, tar) is expelled and/or burned.

The effluent leaving the packed column is fed to quench cooler 7 by line 6, where the temperature is lowered by mixing with the cooling agent (water, benzene, or heptane) fed via line 8 till circa 150° C.

The vapour mixture leaves the column by line 9 to condensor 10 where the temperature is lowered to condense the mixture. If the cooling agent is water the temperature is lowered to abt. 100° C. at which temperature also the hydrogen halogenide (HCl), nitrogen compounds ($NH_3$) and possibly sulphur compounds ($H_2S$) are absorbed.

If the coolant is benzene or heptane the temperature is lowered to abt. 70° C. at which temperature benzene and heptane condensate. The liquid phase formed is removed via line 11. The remaining gas/vapour mixture leaves the condensor via line 12 and enters the absorption column 13 where it is countercurrently contacted with the absorbent e.g. water in which if desired absorption enhancing compounds (e.g. NaOH for the absorption of $H_2S$; $H_2SO_4$ for the absorption of $NH_3$) may be added. The absorption column 13 may be of the tray type or filled with a packing to obtain a good contact between the gas/vapour mixture and the absorbent.

The absorbate goes via line 16 to storage vessel 17. The remaining gases/vapours (hydrogen, light hydrocarbons, co, inert gas) leave by line 15 after which they can be processed (recycling hydrogen and hydrocarbons as fuel).

In the installation according to FIG. 2 the waste material (in the vapour state or as fine granulate) together with the hydrogendonor are fed in a fluidized bed reactor 31 via line 32, in which sand acts as the inert fluidized medium and in which a temperature suitable for the hydrogenolysis is maintained between 900° and 1050° C. The gas leaving the fluidized bed together with entrained sand enters cyclone 34 via line 33 where the sand is separated from the effluent.

The sand returns to reactor 31 by line 35 and effluent gas without sand is quenched in the system comprising the quench cooler 7, condensor 10, absorption column 13 and connecting lines and supply lines, functioning in the same way as described before in connection with FIG. 1. That is, the effluent leaving the packed column is fed to quench cooler 7 by line 36, where the temperature is lowered by mixing with the cooling agent (water, benzene, or heptane) fed via line 8 until it reaches about 150° C.

The vapor mixture leaves the column by line 9 to condenser 10 where the temperature is lowered to condense the mixture. If the cooling agent is water the temperature is lowered to about 100° C. at which temperature the hydrogen halogenide (HCl), nitrogen compound ($NH_3$) and possibly the sulphur compounds ($H_2S$) are absorbed.

If the coolant is benzene or heptane, the temperature is lowered to about 70° C. at which temperature benzene and heptane condense. The liquid phase formed is removed via line 11. The remaining gas/vapor mixtures leaves the condenser via line 12 and enters the absorption column 13.

During the hydrogenolysis soot and/or tar is deposited on the sand granulate. As soon as the activity of the column has diminished between 1 and 10% by soot and tar disposition, the waste feed is stopped while the feed of hydrogen (donor) continues, or (in the case of hydrogen) the waste feed is diminished, until the soot and/or tar disposition has been removed and the activity of the column is restored to the original level. Subsequently the feeding of waste is brought to the original level and the process is started again.

In this way proper action of the fluidized bed reactor is guaranteed, without danger of development of an oxidizing atmosphere.

EXAMPLE I

An installation is used as depicted in FIG. 4. A packed column with the feed and return lines, indicated with the same numbers as in FIG. 1 working in the same way as described before. That is, a vertical reactor vessel filled with e.g. raschigrings, act as packed column 1. A pipeline 2 for feeding hot combustion gases generated in the usual way (not depicted) by burning hydrocarbon fuel varying from propane to naphtao with air or oxygen enriched air, or used for feeding gas for burning off soot, and a discharge line for used combustion gases, 1. A pipeline 4 for feeding waste material to hydrogenolysed and a pipeline 5.

The gas/vapour effluent from the packed column passes for analysis of the effluent through a quench system consisting of a scrubbing bottle 19, in which the effluent bubbles through 5–10 cm water, and through line 24 to a second scrubbing vessel 20 where the effluent bubbles through 15–25 cm water, a drying tube 21, e.g. filled with calcium chloride, in which water vapour from the cooled effluent is removed, and subsequently a storage vessel 22 which is placed in a dewar vessel 23, filled with liquid nitrogen, in which all vapour components are condensed and retained.

The remaining gas (hydrogen) leaves by line 25.

In this installation several experiments have been performed with the following model compounds:

Chloro benzene 2,4-dichlorophenol in benzene (mol. ratio 1:1).

The packed column has a height of 1.5 m and a diameter of 7.5 cm and is filled for 1.25 m with raschig rings of 3.2 mm diameter and 3.2 mm height (the volume taken by the raschig rings is 5.5 l; porosity of the packing 0.7; contact area 5.5 $dm^2$).

In both experiments first combustion gases obtained by the combustion of propane with air (temperature 1500° C.) are led through the column, until the temperature of the packing in the top of the (column measured a 2 cm depth in the packing) has been raised to 1050° C.

The column is flushed during a short time with hot inert gas e.g. nitrogen to remove traces of oxygen. Subsequently a mixture of the model compound and hydrogen (temperature 250° C.) is led through the column.

After 10 minutes the reaction is interrupted and the column is flushed during a short time with hot inert gas followed by air in which way soot and/or tar on the packing is burnt off and the temperature of the packing is brought again at 1050° C.

The reaction conditions and the results are shown in the following table:

| | | EXPERIMENT 1 (CHLOROBENZENE) | EXPERIMENT 2 (2.4-DICHLOROPHENOL IN BENZENE) |
|---|---|---|---|
| AMOUNT OF MODEL COMPOUND | (MG/S) | 78.8 | 32.5 |
| | (M. MOL/S) | 0.7 | 0.2 |
| AMOUNT OF DILUTANT | (MG/S) | — | 15.5 |
| | (M. MOL/S) | — | 0.2 |
| AMOUNT OF HYDROGEN | (M. MOL/S) | 3.5 | 3.6 |
| MOL RATIO MODEL COMPOUND/HYDROGEN | | 1:5 | 1:18 |
| ACTUAL LINEAR VELOCITY THROUGH THE COLUMN (MEAN TEMP. 1000° C.) | (CM/S) | 13.8 | 13.5 |
| CONTACT/REACTION TIME | (S) | 9 | 9.25 |
| DECOMPOSITION GRADE (%) | | 99.91 | 99.9 |

*DECOMPOSITION GRADE HAS BEEN DETERMINED BY GAS CHROMATOGRAPHIC ANALYSIS OF THE EFFLUENT GAS.

EXAMPLE II

An installation depicted in FIG. 2 has been used in which the fluidized bed reactor and regenerator have the parameters as given in the next table.

| | TEST NUMBER | | | | | |
|---|---|---|---|---|---|---|
| Reactor parameters | 1 | 2 | 3 | 4 | 5 | 6 |
| diameter (m) | 2.25 | 2.25 | 2.25 | 2.25 | 2.25 | 2.25 |
| diameter sand particles (mm) | 0.4 ± 0.1 | 0.4 ± 0.1 | 0.4 ± 0.1 | 0.4 ± 0.1 | 0.4 ± 0.1 | 0.4 ± 0.1 |
| bed height (static) (m) | 2 | 2 | 4 | 4 | 4 | 4 |
| bed height (fluidised) (m) | 4 | 4 | 8 | 8 | 8 | 8 |
| superficial gas velocity (m/s) | 0.6 | 0.6 | 0.8 | 0.8 | 0.6 | 0.6 |
| residence time gas in reactor (s) | 3.7 | 3.7 | 7.5 | 7.5 | 8 | 8 |
| temperature reactor (°C.) | 1000 | 1000 | 1000 | 1000 | 1000 | 1000 |
| quantity model substance (mol/s) | 3.8 | 0.2 | 0.07 | 0.55 | 31.5 | 3.15 mg/s |
| quantity dil. substance (mol/s) | — | 0.9 | 1.03 | 0.55 | 2.8 | 2.8 |
| quantity hydrogen (mol/s) | 19 | 21.5 | 21.5 | 21.5 | 19.6 | 19.6 |
| mol. ratio model substance/hydrogen | 1:5 | 1:19.5 | 1:19.5 | 1:19.5 | — | — |
| conversion degree model substance* (%) | >99.9 | >99.9 | >99.9 | >99.9 | >99.9 | >99.9 |

*conversion degree determined by gas chromatographic analysis of effluent gas samples Pipe 36 discharges into quench cooler 7 (heat exchanger in which the hot effluent is contacted with cold cooling liquid) to which a cooling liquid (e.g. water, benzene or heptane) is fed by line 8 a discharge line 9 for transport of the vapor mixture of effluent and cooling liquid to condenser to where the temperature is lowered further. Condenser 10 has a discharge line 11 for the liquid phase and a discharge line 12 for the gaseous components. The gaseous components enter the absorption column 13 by this line 12 where the gaseous components are contacted with an absorbent, e.g. water to remove the hydrogen halogenides, nitrogen and/or sulphur components formed during the hydrogenolysis reaction, the absorbent is added via line 14. The remaining gaseous components (mainly hydrogen, light hydrocarbons and CO) are discharged by line 15 at the top of the absorption column. The absorbent with absorbed hydrogen halogenides, nitrogen, and/or sulphur compounds, is discharged by line 16 to vessel 17 (e.g. hydrochloric acid, ammonia etc.)

Referring now to FIG. 1, when starting the process, hot combustion gases are fed to the column by line 2 to heat the packing. The gas is discharged by line 3. As soon as the temperature of the packing has reached a temperature of 1050°-1300° C., line 2 and 3 are closed and during a short while the column is flushed with hot inert gas. Subsequently, the waste material that has to be hydrogenolised is added in the vapor state (temperature about 400° C.) by line 4 to column 1 and preheated hydrogen (or hydrogendonot) in the vapor state temperature between 200°-400° C. is added by line 5 to column 1. If desirable the waste material and hydrogen (donor) may also be mixed before entering the packed column. The hydrogen (donor) can also be used to spray the liquid waste material into the reactor.

If waste in the solid state has to be processed, e.g. polyvinylchloride waste, it is first milled and then suspended in the hydrogen donor stream and fed to the column. In the column the waste material and the hydrogen (donor) is heated quickly to about 1000°-1200° C., which temperature decreases slowly as the column is used longer. Feeding the waste material and the hydrogen (donor) is interrupted as soon as the temperature at the top of the reactor falls below 950°-1100° C. Subsequently, hot combustion gases are fed again to column 1 to increase the temperature, in which case also carbon containing material deposited on the packing (soot, tar) is expelled and/or burned.

In a first experiment the reactor was started up with dichlorobenzene and hydrogen as the hydrogenating medium.

Subsequently several experiments have been performed in which the reactor was started up with chlorobenzene or with benzene and hydrogen and one of the following model compounds is added to the chlorobenzene or benzene as soon as the stationary state has been reached.

| EXPERIMENT No. | MODEL COMPOUND/DILUTING COMPOUND |
|---|---|
| 1 | DICHLOROBENZENE |
| 2 | CHLOROBENZENE(*) + 1,2,4-TRICHLOROBENZENE (MOL RATIO 4,5:1) |
| 3 | CHLOROBENZENE(*) + POLYCHLOROBYPHENYL (AROCHLOR 1248) (MOL RATIO 15:1) |
| 4 | BENZENE(*) + 2,4-DICHLOROPHENOL (MOL RATIO 1:1) |
| 5 | CHLOROBENZENE(*) + 100 PPM DIBENZO-P—DIOXINE |
| 6 | CHLOROBENZENE(*) + 10 PPM 1,2,3,4-TETRA-CHLOR-P—DIOXINE |

(*)DILUTING COMPOUND.

The reaction conditions and the results are also given in the next table.

EXAMPLE III

The procedure of example II, experiment 1 was repeated, but using methanol as hydrogen donor. The amount of dichlorobenzene added to the reactor was 3.8 mol/s and the amount of methanol was 5 mol/s. Under these circumstances also a decomposition grade exceeding 99.9% has been found.

EXAMPLE IV

The procedure according to the invention with the use of two reactors in series as indicated in FIG. 3, in which the reactors are identical to the reactor described in example I, that is a vertical reactor vessel filled with, e.g. raschig-rings, act as packed column 1. A pipeline 2 for feeding hot combustion gases generated in the usual way (not depicted) by burning hydrocarbon fuel varying from propane to naphtao with air or oxygen enriched air, or used for feeding gas for burning off soot, and a discharge lined for used combustion gases, 1. A pipeline 4 for feeding waste material to bed hydrogenolysed and a pipeline 5, for hydrogen gas (if necessary mixed with inert gas like e.g. Nitrogen), or for hydrogen donor gas or vapor, e.g. methanol. The discharge line 6, for the gaseous effluent of the packed column 1, ends in a quench cooler 7 (heat exchanger in which the hot effluent is contacted with cold cooling liquid) to which a cooling liquid (e.g. water, benzene or heptane) is feed by line 8.

A discharge line 9 for transport of the vapor mixture of effluent and cooling liquid to condenser 10, where the temperature is lowered further. Condenser 10 has a discharge line 11 for the liquid phase which then goes into second Reactor 1 described below. There is a discharge line 12 for the gaseous components. The gaseous components enter the absorption column 13 by this line 12 where the gaseous components are contacted with an absorbent, e.g. water to remove the hydrogen halogenides, nitrogen and/or sulphur components formed during the hydrogenolysis reaction, the absorbent is added via line 14. The remaining gaseous components (mainly hydrogen, light hydrocarbons and CO) are discharged by line 15 at the top of the absorption column. The absorbent with absorbed hydrogen halogenides, nitrogen and/or sulphur compounds, is discharged by line 16 to vessel 17 (e.g. hydrochloric acid, ammonia etc.)

Second Reactor 1 that is a vertical reactor vessel filled with e.g. raschig-rings, acts as a packed column 1. A pipeline 2 for feeding hot combustion gases generated in the usual way (not depicted) by burning hydrocarbon fuel varying from propane to naphtao with air or oxygen enriched air, or used for feeding gas for burning off soot, and a discharge line for used combustion gases, 1. A pipeline 4 for feeding waste material to bed hydrogenolysed and a pipeline 5, for hydrogen gas (if necessary mixed with inert gas like e.g. Nitrogen), or for hydrogen donor gas or vapor, e.g. methanol. The discharge line 6, for the gaseous effluent of the packed column 1, ends in a quench cooler 7 (heat exchanger in which the hot effluent is contacted with cold cooling liquid) to which a cooling liquid 9 (e.g. water, benzene or heptane) is feed by line 8.

The temperature of the first reactor kept at 900° C. and that of the second reactor at 1050° C. The gaseous effluent of the first reactor is washed with a 10% caustic soda solution.

The reaction conditions and the results were as follows: mol ratio chlorobenzene/hydrogen 1:4 residence time first reactor 8 sec., second reactor 7 sec.; decomposition grade after the second reactor over 99.9999%.

I claim:

1. Process for the destruction of biologically difficult to degrade waste materials comprising compounds selected from the group consisting of halogen-, nitrogen-, sulphur-, and/or oxygen compounds by thermal decomposition comprising heating the waste materials together with excess hydrogen and/or hydrogen donor during 1 to 10 sec. to a temperature between 700°-1220° C., quenching the gaseous effluent of the reaction and separating it in a hydrocarbon and hydrogen containing phase and a hydrogen halogenide(s), nitrogen-, sulphur-, and/or oxygen containing compounds containing phase.

2. The process of claim 1 wherein the hydrogenolysis is performed in two steps, the first during 1-10 sec. at 700°-900° C. and second during 1-10 sec. at 850°-1200° C.

3. The process of claim 2 wherein the temperature is maintained in the second step between 950° and 1050° C.

4. The process of claim 2 wherein a plug flow reactor packed column or fluidized bed reactor is utilized in the first step depending on the evaporisation characteristics of the waste material.

5. The process of claim 2, wherein a packed column is used in the second step reactor in which the packing enhances the transfer of heat.

6. The process of claim 2, wherein a fluidized bed reactor is utilized in the second step with a bed of inert granular material as a heat transfer medium.

7. The process of claim 1 wherein the amount of hydrogen and or hydrogen donor is between 1.2-10 equivalent hydrogen per equivalent bonds to be broken in the waste material.

8. The process of claim 7 wherein amount of hydrogen and/or hydrogen donor is 2 to 4 equivalent per equivalent bonds to be broken.

9. The process of claim 2 wherein the waste material and/or the hydrogen or hydrogen donor is preheated before entering the reactor.

10. The process of claim 9 wherein the preheat temperature is between 200°-500° C.

11. The process of claim 1 wherein methanol is the hydrogen donor.

12. The process of claim 1 wherein the waste material is dispersed with a hot neutral or reducing gas.

13. The process of claim 12 wherein the waste material is dispersed with the hot hydrogen or hydrogen donor.

14. The process according to claim 1 wherein the gaseous effluent of the reaction is quenched with a cold hydrocarbon with a boiling point between 60° and 100° C.

15. The process of claim 14 wherein benzene is the quenching agent.

16. The process of claim 14 wherein heptane is the quenching agent.

17. The process of claim 1 wherein water is the quenching agent.

18. The process of claim 1 wherein the separation of the gaseous effluent in a hydrocarbon and hydrogen containing phase and a hydrogen halogenides(s), nitrogen-, sulphur-, and similar compounds containing phase by contacting the effluent with an absorbent for the last mentioned compounds.

19. The process of claim 1 wherein water is the absorbent.

20. The process of claim 2 wherein the effluent of the first step separation of the hydrogen halogenide(s), hydrogen sulfide, hydrogen cyanide and/or ammonia) is quenched before leading the hydrocarbons, hydrogen and unreacted waste to the second step.

21. The process of claim 1 wherein the heating of the waste material with excess hydrogen and/or hydrogen donor is regularly interrupted in order to burn off deposited soot.

22. The process of claim 4 wherein addition of waste material to be heated is interrupted or diminished after noticing a diminishing of the activity of the column so that soot can react with the hydrogen.

23. Process for the destruction of biologically difficult to degrade waste materials comprising compounds selected from the group consisting of halogen-, nitrogen-, sulphur- and/or oxygen compounds by thermal decomposition consisting of the steps of heating the waste materials together with excess hydrogen and/or hydrogen donor during 1 to 10 seconds to a temperature between 700°-1220° C., quenching the gaseous effluent of the reaction and separating it in a hydrocarbon and hydrogen containing phase and a hydrogen halogenide, nitrogen-, sulphur-, and/or oxygen containing compounds containing phase.

24. The process, as in claim 1 wherein the biologically difficult to degrade substances are selected from the group consisting of aldrin, dieldrin, chlordane, hexachlorocylcohexane, toxic polychlorinated biphenyls, transformer oils, residues of the preparation of pesticides and polychlorinated bipheny's which contain traces of pesticides, toxic oxygen containing compounds, and polyvinyl-chloride waste.

25. The process as in claim 24 wherein the toxic oxygen containing compounds comprises dioxine.

26. The process, as in claim 1 which is not influenced by the presence of metals or metal salts.

27. The process, as in claim 1, wherein the hydrogen donor is a compound that splits off hydrogen.

* * * * *